United States Patent [19]

Alvarez

[11] Patent Number: 4,612,717

[45] Date of Patent: Sep. 23, 1986

[54] RETAINING GUIDE FOR ELECTRIC IRON CORD

[76] Inventor: Linda F. Alvarez, 20518 Varsity Dr., Walnut, Calif. 91789

[21] Appl. No.: 756,743

[22] Filed: Jul. 18, 1985

Related U.S. Application Data

[63] Continuation-in-part of Ser. No. 611,033, May 16, 1984, abandoned.

[51] Int. Cl.[4] ..... D06F 83/00

[52] U.S. Cl. ..... 38/104; 38/140; 24/115 R; 24/265 AL; 248/51; 248/74.1

[58] Field of Search ..... 38/140, 141, 142, 104, 38/106, 111; 248/51, 52, 53, 74.1; 24/265 AL, 115 K, 241 R, 132 R, 115 R, 129 R; 160/84 R

[56] References Cited

U.S. PATENT DOCUMENTS

| | | | |
|---|---|---|---|
| Re. 16,194 | 11/1925 | Bass | 38/140 |
| 1,164,928 | 12/1915 | Corcoran | 248/51 |
| 1,172,134 | 2/1916 | Harold | 248/51 |
| 1,522,684 | 1/1925 | Howard | 38/142 X |
| 1,665,316 | 4/1928 | Matthews | 38/142 X |
| 3,733,724 | 5/1973 | Davis | 38/140 |
| 4,088,170 | 5/1978 | Franklin | 160/84 R |
| 4,417,710 | 11/1983 | Adair | 248/51 |

FOREIGN PATENT DOCUMENTS

| | | | |
|---|---|---|---|
| 1194548 | 11/1959 | France | 248/51 |

*Primary Examiner*—Werner H. Schroeder
*Assistant Examiner*—Andrew M. Falik
*Attorney, Agent, or Firm*—Boniard I. Brown

[57] ABSTRACT

A retaining guide for an electric iron cord which extends between an electric outlet and an electric iron atop an ironing board includes a ring for sliding extension of the cord therethrough during movement of the electric iron atop the ironing board. The retaining guide includes features defining at least one opening on the ironing board for extension of the ring therethrough ironing board cover for extension of a relatively taut portion of the cord between the ring and the electric iron during movement of the iron atop the board. The ring preferably comprises hingedly connected members having outer end portions adapted for detachable engagement for opening to receive the electric cord and engageable to close the ring to retain the cord.

18 Claims, 7 Drawing Figures

RETAINING GUIDE FOR ELECTRIC IRON CORD

BACKGROUND OF THE INVENTION

In the use and movement of electric irons atop electric ironing boards, problems are encountered with the electric cord interconnecting the electric iron with an electric outlet, in that the flexible electric cord often becomes caught on the ironing board edge, becomes entangled, and becomes positioned in the path of the electric iron, with resultant, annoyance, interference with ironing operations, delays in repositioning the cord, and general interference and diminishing of efficiency.

Electric iron cord retaining guides and retractors, contractors or controllers, have been known in the prior art. Such devices are shown and described, as examples, in U.S. Pat. Nos. 1,522,684, 1,665,316, 2,680,789, 2,979,296, and 3,866,869.

Such prior devices are characterized by shortcomings and disadvantages. They are generally somewhat complicated and relatively expensive. Being attached to an ironing board and projecting outwardly therefrom, they constitute obstructions and are in the way in the storing of the ironing board when not in use, and tend to obstruct movement of the electric iron and the person using the electric iron.

It is therefore an object of the present invention to overcome or alleviate the aforementioned and other disadvantages and shortcomings of prior devices.

An object of the invention is the provision of a retaining guide for an electric iron cord which enables efficient and rapid ironing operations.

An object of the invention is to provide a retaining guide for an electric iron cord which is of simplified and inexpensive construction.

An object of the invention is the provision of such a retaining guide for an electric iron cord which is attached to or mounted on an ironing board cover fitted about an ironing board.

It is an object of the invention to provide such a retaining guide which maintains and positions an electric iron cord to prevent the cord occupying any such position as would interfere with a persons' operation of an iron atop an ironing board, and which essentially eliminates the necessity for interrupting ironing operations to manipulate or move the electric cord out of the way of an electric iron during ironing operation.

An object of the invention is the provision of such a retaining guide which does not interfere with manipulation of an ironing board during folding thereof for storage, and which has no tendency to be broken or damaged during handling or manipulation of the ironing board or electric iron.

It is an object of the invention to provide such a retaining guide which utilizes a ring memter which is readily openable to receive an electric iron cord which is readily closable to slidably retain the electric cord.

SUMMARY OF THE INVENTION

The aforementioned objects and advantages, as well as other objects which will become apparent from the description of the preferred embodiments, are achieved in a retaining guide for an electric iron cord which extends between an electric power outlet and an electric iron atop an ironing board. The retaining guide is disposed on or in a fabric ironing board cover which is configurated and sized to fit over the top and about the edges of the ironing board. The ring is adapted for the slidable extension therethrough of the board during movement of the electric iron atop and about the ironing board, and ring attachment means provide for the extension of a relatively taut portion of the cord between the ring and the iron in all positions of the iron during movement thereof atop the ironing board. The ring typically comprises two hingedly connected arcuate members which have their outer end portions adapted for detachable engagement, thus providing for the detachment of the outer end portions to receive an electric cord and for engagement thereof to close the ring for slidable retention of the cord. A weight may be connected to or suspended from the cord between the ironing board cover and the electric outlet to exert tension or force to maintain the cord in a relatively taut condition between the electric iron and the ring during maneuvering of the iron atop the ironing board.

The ring attachment means may comprise a loop of fabric attached, as by stitching, to the ironing board cover, with the ring extending through such loop, or a pair of eyelets defining spaced openings with the ring extending therethrough, such eyelet-defined spaced openings preferably being defined in a portion of the ironing board cover overlying the ironing board adjacent an edge of the board. The ring attachment means may also comprise an opening defined by eyelets impressed on either side of an outwardly extending fold of the ironing board cover, with the ring extending therethrough. The ring attachment means may also comprise two spaced buttonholes in the ironing board cover with the ring extending therethrough. A single buttonhole may comprise the ring attachment means, such single buttonhole being defined in a portion of the ironing board cover which overlies an edge of the ironing board.

The ring attachment means may preferably be positioned on a portion of the ironing board cover overlying and adjacent to an edge of the ironing board.

DESCRIPTION OF PREFERRED EMBODIMENT

Figure 1:
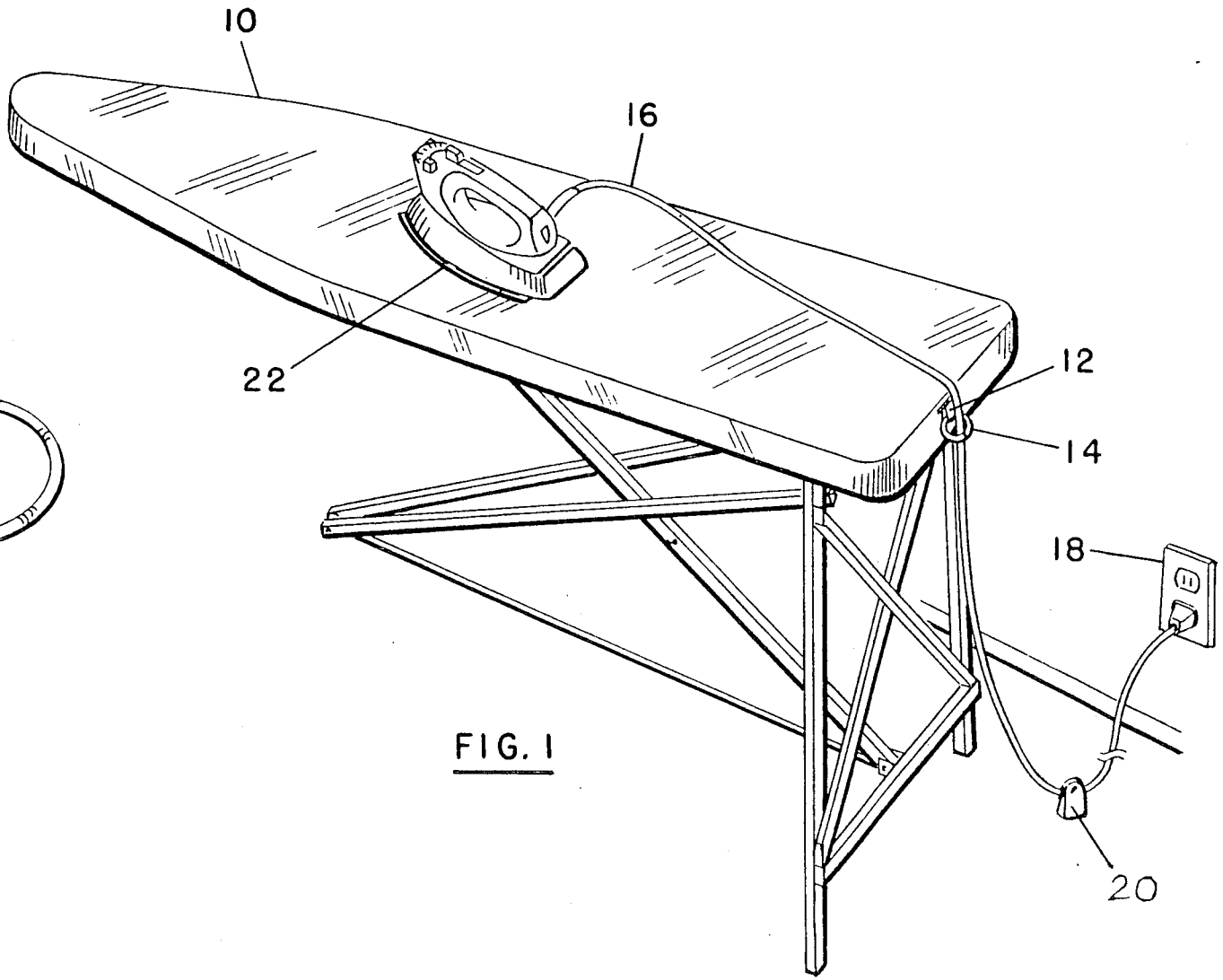
FIG. 1 is a perspective view showing one preferred embodiment of the present invention in operative relation with an electric iron, an electric cord, and an ironing board.
Figure 2:
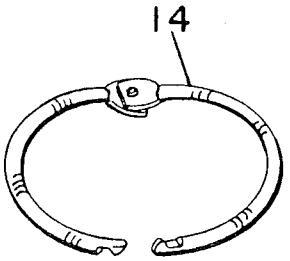
FIG. 2 is a perspective view of a preferred form of ring utilized with the invention, showing hinged portions of the ring in open configuration.
Figure 3:
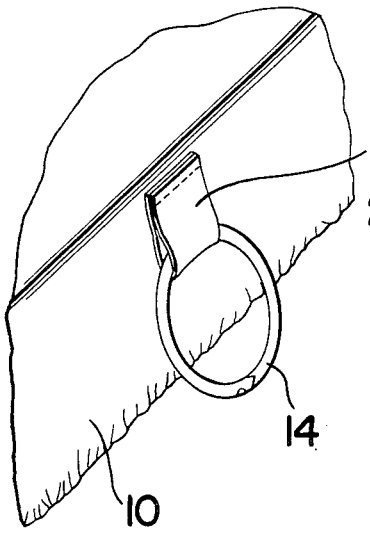
FIG. 3 is an enlarged partial perspective view of a portion of FIG. 1.

Referring to the drawings, and particularly to FIGS. 1, 2 and 3, one preferred form of the invention, comprising a fabric loop 12 and a ring 14, is shown in operative relation with an ironing board cover 10 fitted about a conventional ironing board, as shown. The fabric loop 12 is attached to a portion of the ironing board cover 10 which overlies an edge of the ironing board, and is attached thereto by being sewn by stitching. Ring 14 extends through fabric loop 12. An electric cord 16 extends between an electric outlet 18 and an electric iron 22. The cord is slidably received in ring 14 and extends slidably therethrough. If desired or needed, a weight 20 may be suspended upon the cord 16 between the ring 14 and the electrical outlet, although in some or most situations the cord itself provides sufficient weight to retract and maintain relatively taut the electric cord portion between the electric iron and ring 14.

As best shown in FIG. 2, the ring 14 is comprised of two hinged members having mutually engagable outer end portions, one end portion defining a notch and the other a lug. The ring may thus be opened, as indicated in FIG. 2, to receive the electric cord 16 and to extend through the fabric loop 12 to attach the ring to the ironing board cover 10 in the manner indicated in FIG. 3. The ring may also be opened for removal of the electric cord after ironing operations are complete for purposes of storage, etc. The ring may be fabricated of any appropriate material, such as metal or appropriate plastic.

Figure 4:
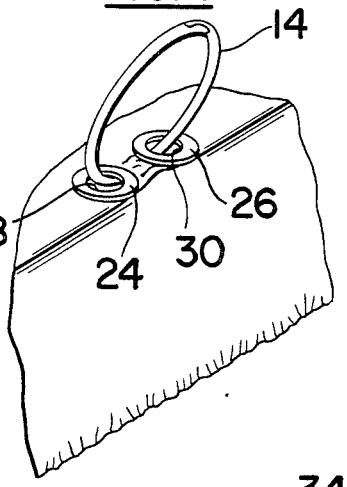
FIG. 4 is a view similar to the view of FIG. 3, and showing another preferred embodiment of the invention.

FIG. 4 shows an embodiment of the invention wherein the ring is attached by attachment means comprising a pair of eyelets 24, 26 which are impressed about and define spaced openings 28, 30 in a portion of the ironing board cover overlying an edge, typically an end edge, of the ironing board. The ring 14 is attached by extension thereof through the openings 28, 30, as shown.

Figure 5:
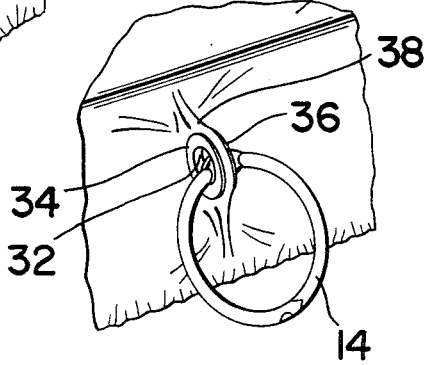
FIG. 5 is a view similar to the view of FIG. 3, showing another embodiment of the present invention.

Illustrated in FIG. 5 is an embodiment of the invention wherein the ring attachment means comprises an opening 32 defined by eyelets 34, 36 impressed about the opening on either side of an outwardly extending fold 38 of the ironing board cover fabric, with the ring extending through the opening, as shown.

Figure 6:
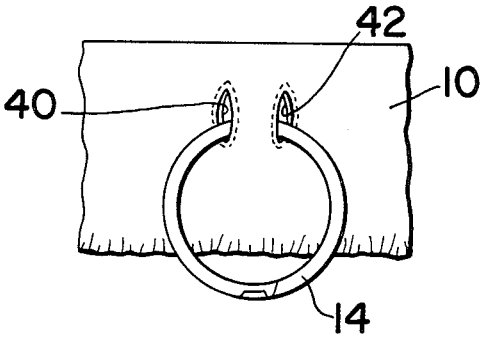
FIG. 6 is a fragmentary elevational view, generally similar to the views of FIGS. 3 to 5, and showing another embodiment of the present invention.

FIG. 6 shows an embodiment of the invention wherein the ring attachment means comprises two buttonholes 40, 42 in the ironing board cover and spaced apart therein, with the ring 14 extending through the buttonholes.

Figure 7:
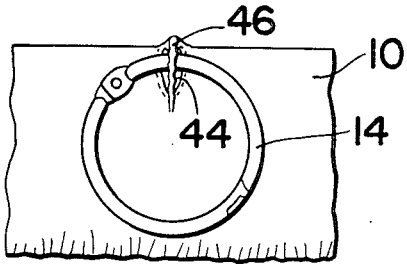
FIG. 7 is a view similar to the view of FIG. 6 and showing another embodiment of the invention.

FIG. 7 illustrates another embodiment of the invention, wherein the ring attachment means comprises a single buttonhole 44 defined through two layers of the ironing board cover fabric of an outwardly extending fold 46 of the cover fabric overlying an edge of an ironing board, and the ring extends through said buttonhole.

In utilizing the retaining guide of the invention during movement of the electric iron 22 about the top of the ironing board during ironing operations, when the iron 22 is moved from right to left, as viewed in FIG. 1, cord 16 is drawn through ring 14 and is maintained above the ironing board in a relatively taut and untangled condition between the ring and the electric iron. Upon movement of the iron rightward, as viewed, the cord is retracted through the ring to maintain it taut and untangled, this retraction being effected by the weight of the cord portion between the ring and the electric outlet, and by the added weight 20 suspended from the electric cord, if such weight is utilized.

The retaining guide thus assures that the electric cord remains in position above the ironing board in a relatively taut and untangled condition between the electric iron and the ring. The cord does not occupy any position wherein it would interfere with manipulation of the iron during ironing operation. The cord is prevented from falling off any edge of the ironing board, and from becoming caught on any portion of the ironing board. The cord is prevented from becoming entangled with articles being ironed, such as when such an article is draped over an edge of the ironing board. The cord is prevented from otherwise interfering or interrupting ironing operations. Ironing operations may be performed quickly and efficiently, utilizing the retaining guide of the invention, with the cord being so maintained as to avoid significant probability of the cord occupying any position which would interfere with manipulation of the electric iron atop the ironing board. Any necessity for interrupting ironing operations to manipulate or move the electric cord out of the way of an electric iron or from engagement with an article being ironed is substantially eliminated.

There has been shown and described a novel retaining guide for electric iron cord which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A retaining guide for an electric iron cord extending between an electric power outlet and an electric iron atop an ironing board having a top surface and edges, said retaining guide comprising:

a fabric ironing board cover configurated and sized to fit over the top and about the edges of the ironing board, a ring adapted for sliding extension therethrough of the electric iron cord during movement of the electric iron atop the ironing board, and means on the cover for attaching the ring to the ironing board cover, said means defining at least one opening on the ironing board cover for extension of the ring therethrough for extension of a relatively taut portion of the electric cord between the ring and the iron in all positions of the iron atop the board.

2. A retaining guide according to claim 1, wherein:

said ring comprises two hingedly connected arcuate members having outer end portions adapted for detachable engagement for detachment of the end portions to receive the electric cord and engagement of the end portions to close the ring to slidably retain the cord.

3. A retaining guide according to claim 2, and further including:

a weight connected to the electric cord intermediate the ironing board cover and said electric outlet to maintain the cord relatively taut between the electric iron and the ring during movement of the iron atop the ironing board.

4. A retaining guide according to claim 2, wherein:

said ring attaching means comprises a loop of fabric material attached to the ironing board cover, and said ring extends through said loop.

5. A retaining guide according to claim 2, wherein:

said ring attachment means comprises a pair of eyelets defining spaced openings in said ironing board cover, and said ring extends through said eyelets.

6. A retaining guide according to claim 5, wherein: said eyelets and spaced openings are in a portion of the ironing board cover overlying the top of the ironing board adjacent an ironing board edge.

7. A retaining guide according to claim 2, wherein: said ring attachment means comprises a single opening defined by eyelets on either side of an outwardly extending fold of the ironing board cover fabric, and the ring extends through the opening.

8. A retaining guide according to claim 2, wherein: the ring attachment means comprises two buttonholes spaced apart in the ironing board cover, and said ring extends through the buttonholes.

9. A retaining guide according to claim 2, wherein: the ring attachment means is a single buttonhole defined through two layers of cover fabric of an outwardly extending fold of the ironing board cover overlying an edge of the ironing board, and the ring extends through said buttonhole.

10. A retaining guide according to claim 2, wherein: said ring attaching means is disposed on a portion of the ironing board cover adjacent to an edge of the ironing board.

11. A retaining guide according to claim 1, and further including:

a weight connected to the electric cord intermediate the ironing board cover and said electric outlet to maintain the cord relatively taut between the electric iron and the ring during movement of the iron atop the ironing board.

12. A retaining guide according to claim 1, wherein: said ring attaching means comprises a loop of fabric material attached to the ironing board cover, said loop defining said opening through which the ring extends.

13. A retaining guide according to claim 1, wherein: said ring attachment means comprises a pair of eyelets defining spaced openings in said ironing board cover, and said ring extends through said eyelets.

14. A retaining guide according to claim 13, wherein: said eyelets and spaced openings are in a portion of the ironing board cover overlying the top of the ironing board adjacent an ironing board edge.

15. A retaining guide according to claim 1, wherein: said ring attachment means comprises a single opening defined by eyelets on either side of an outwardly extending fold of the ironing board cover fabric, and the ring extends through the opening.

16. A retaining guide according to claim 1, wherein: the ring attachment means comprises two buttonholes spaced apart in the ironing board cover, and said ring extends through the buttonholes.

17. A retaining guide according to claim 1, wherein: the ring attachment means is a single buttonhole defined through two layers of cover fabric of an outwardly extending fold of the ironing board cover overlying an edge of the ironing board, and the ring extends through said buttonhole.

18. A retaining guide according to claim 1, wherein: said ring attaching means is disposed on a portion of the ironing board cover adjacent to an edge of the ironing board.

* * * * *